US009489782B2

(12) United States Patent
Payne et al.

(10) Patent No.: US 9,489,782 B2
(45) Date of Patent: Nov. 8, 2016

(54) COLLECT VEHICLE PERFORMANCE WITH A PDT

(75) Inventors: Gregory Payne, Charlotte, NC (US); Paul Weslake, Waxhaw, NC (US)

(73) Assignee: Hand Held Products, Inc., Fort Mill, SC (US)

( * ) Notice: Subject to any disclaimer, the term of this patent is extended or adjusted under 35 U.S.C. 154(b) by 267 days.

(21) Appl. No.: 12/845,356

(22) Filed: Jul. 28, 2010

(65) Prior Publication Data

US 2012/0029764 A1 Feb. 2, 2012

(51) Int. Cl.
*G07C 5/08* (2006.01)

(52) U.S. Cl.
CPC ..... *G07C 5/0891* (2013.01); *G07C 5/0866* (2013.01)

(58) Field of Classification Search
CPC G07C 5/0866; G07C 5/0891; G07C 5/0841; G07C 5/085; G07C 5/0875; G07C 5/0883; G07C 5/008; B60R 2001/1253; B60R 21/013; B60R 2021/01315; B60R 21/015; B60R 21/01512; B60R 21/0153; B60R 21/01538
USPC ..... 235/472.01, 472.02, 472.03; 701/29.1, 701/32.2, 32.3, 32.4, 32.5, 33.2, 33.3, 33.4
See application file for complete search history.

(56) References Cited

U.S. PATENT DOCUMENTS 5,801,371 A * 9/1998 Kahn et al. ..... 235/472.01
6,049,747 A * 4/2000 Nakajima ..... B60N 2/002 340/576
6,347,744 B1 * 2/2002 Metlitsky ..... G06K 7/10683 235/462.46
6,418,372 B1 7/2002 Hofmann
6,429,773 B1 * 8/2002 Schuyler ..... 340/425.5
6,470,268 B1 10/2002 Ashcraft et al.
6,662,104 B2 12/2003 Ito et al.
6,701,234 B1 * 3/2004 Vogelsang ..... 701/32.4
6,831,556 B1 * 12/2004 Boykin ..... H04N 7/181 340/539.1
7,062,378 B2 6/2006 Krull et al.
7,243,024 B2 7/2007 Endicott
8,594,743 B2 11/2013 Sano
2002/0035422 A1 3/2002 Sasaki (Continued)

FOREIGN PATENT DOCUMENTS

JP 08235484 9/1996
JP 200242288 A 2/2002

(Continued)

OTHER PUBLICATIONS

Japanese Office Action in Related Japanese Application No. 2011-151680, Dated Jun. 12, 2015, 9 pages, Machine Translation provided.

(Continued)

*Primary Examiner* — Stephen Holwerda
(74) *Attorney, Agent, or Firm* — Additon, Higgins & Pendleton, P.A.

(57) ABSTRACT

A mobile device includes: a display; a data reader for reading data from an information bearing medium; at least one vehicle data collection device; a global positioning system (GPS); a wireless communications module; a memory device; a processor; and a housing configured for placement in a vehicle and supporting the display, the data reader, the vehicle data collection device, the GPS module, the wireless communications module, the memory device and the processor, wherein the vehicle data collection device facilitates monitoring at least one vehicle performance characteristic.

20 Claims, 4 Drawing Sheets

(56) References Cited

U.S. PATENT DOCUMENTS

| | | | | |
|---|---|---|---|---|
| 2002/0036565 | A1* | 3/2002 | Monroe | G08G 1/017 340/425.5 |
| 2003/0114206 | A1* | 6/2003 | Timothy | G06F 1/1626 455/575.7 |
| 2003/0154009 | A1* | 8/2003 | Basir | G07C 5/0891 701/32.2 |
| 2005/0203683 | A1* | 9/2005 | Olsen | B60R 25/1004 701/29.3 |
| 2008/0023547 | A1* | 1/2008 | Raichle et al. | 235/462.13 |
| 2008/0198221 | A1 | 8/2008 | Liou | |
| 2010/0124947 | A1 | 5/2010 | Sano | |
| 2010/0157061 | A1 | 6/2010 | Katsman et al. | |

FOREIGN PATENT DOCUMENTS

| | | | |
|---|---|---|---|
| JP | 2002293165 | | 10/2002 |
| JP | 2004288124 | | 10/2004 |
| JP | 2006160126 | | 6/2006 |
| JP | 2007258881 | | 10/2007 |
| JP | 2010119019 | A | 5/2010 |
| WO | WO2009132600 | A1 | 11/2009 |

OTHER PUBLICATIONS

Chinese First Office Action in related CN Application 201110211698.8, Dated Mar. 26, 2015, 19 pages, English Translation included.

European Exam Report in related EP Application No. 11172947.1, Dated Feb. 11, 2016, 4 pages. References previously cited.

Japanese Final Office Action in related Application No. 2011-151680, Dated Jan. 6, 2016, English Translation provided, 10 pages.

English-translation of Second Office Action in related Chinese Application 201110211698.8, Dated Oct. 13, 2015, 4 pages.

Japanese Final Decision of Rejection and Decision of Dismissal of Amendment, in related JP Application No. 2011-151680, Dated Aug. 8, 2016, 14 pages (English machine translation provided).

* cited by examiner

COLLECT VEHICLE PERFORMANCE WITH A PDT

FIELD OF THE INVENTION

The present invention relates to mobile devices, and more particularly to a mobile device configured for tracking vehicular performance.

BACKGROUND

Data reading devices read or obtain data or information from an information bearing medium, such as a card having a magnetic strip (mag strip) or symbol indicia (such as one or two dimensional symbologies), a Radio-frequency identification (RFID) instrument, biometric information such as a fingerprint, etc.

Data readers may be a mobile device, such as a hand held scanner, a portable data terminal (PDT), personal digital assistant (PDA), mobile phone, etc.

Efforts regarding such systems have led to continuing developments to improve their versatility, practicality and efficiency.

DETAILED DESCRIPTION

Figure 1:
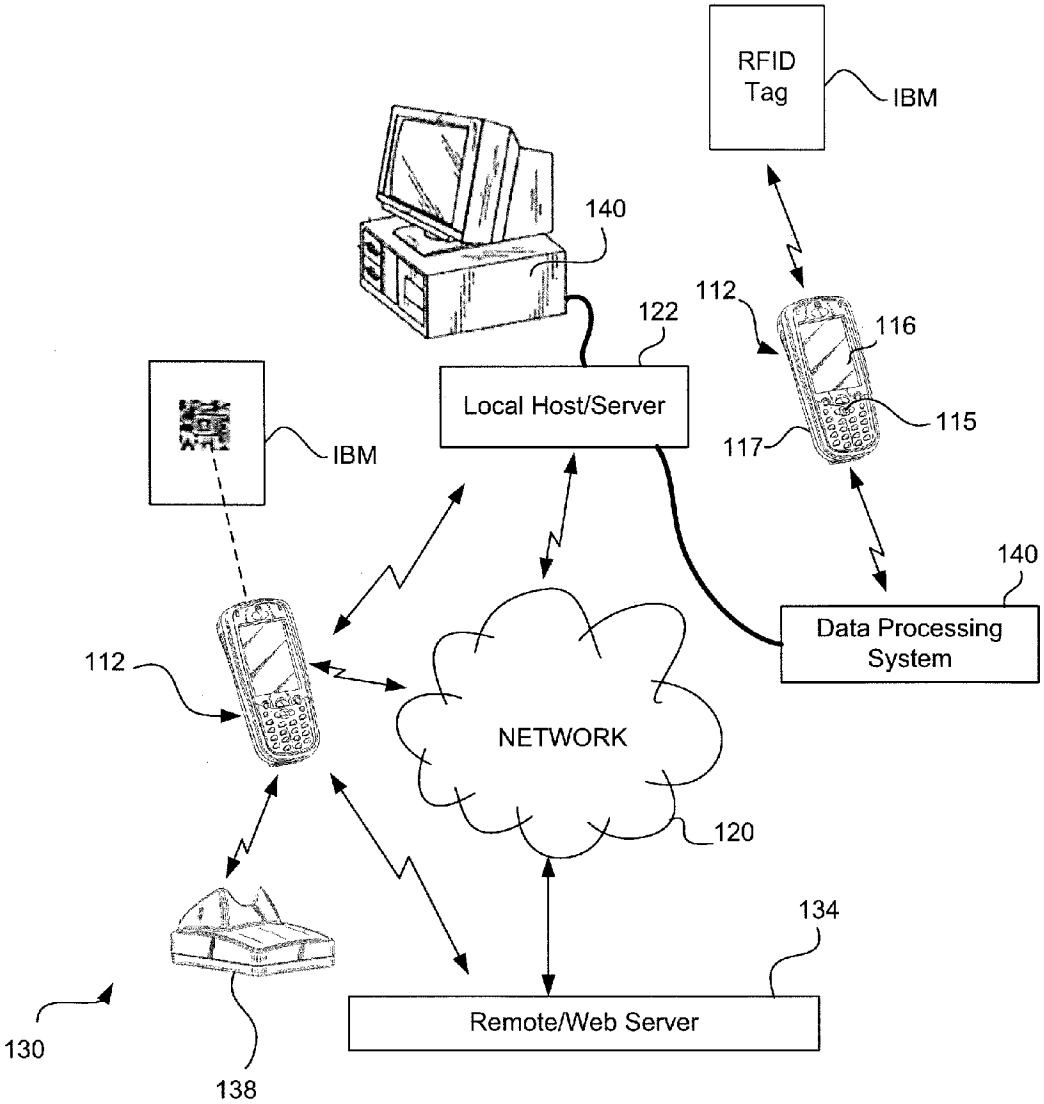
FIG. 1 is a block diagram of an exemplary data reader system.

Reference will now be made to exemplary embodiments which are illustrated in the accompanying drawings. Other embodiments may be in various forms and the exemplary embodiments should not be construed as limited to the embodiments set forth herein. Rather, these representative embodiments are described in detail so that this disclosure will be thorough and complete, and will fully convey the scope, structure, operation, functionality, and potential applicability to those skilled in the art. Wherever possible, the same reference numbers will be used throughout the drawings to refer to the same or like parts. The term "scan" or "scanning" used herein refers to reading or extracting data from an information bearing indicia (or symbol). The term imaging used herein refers to the taking or creation of an electronic image.

Exemplary methods may be conceived to be a sequence of steps or actions leading to a desired result and may be implemented as software. While it may prove convenient to discuss such software as if were embodied by a single program, most implementations will distribute the described functions among discrete (and some not so discrete) pieces of software. These pieces are often described using such terms of art as "programs." "objects." "functions." "subroutines," "libraries," ".dlls." "APIs." and "procedures." While one or more of these terms may find favor in the present description, there is no intention to limit the invention to the described configurations.

In general, the sequences of steps in the present methods require physical manipulation of physical quantities. These quantities take the form of optical, electrical or magnetic signals capable of being stored, transferred, combined, compared or otherwise manipulated. Those of ordinary skill in the art conveniently refer to these signals as "bits", "values", "elements", "symbols", "characters", "images", "terms", "numbers", or the like. It should be recognized that these and similar terms are to be associated with the appropriate physical quantities and are merely convenient labels applied to these quantities.

With respect to the software described herein, those of ordinary skill in the art will recognize that there exist a variety of platforms and languages for creating software for performing the methods outlined herein. Embodiments of the present invention can be implemented using MICROSOFT VISUAL STUDIO or any number of varieties of C. However, those of ordinary skill in the art also recognize that the choice of the exact platform and language is often dictated by the specifics of the actual system constructed, such that what may work for one type of system may not be efficient on another system. It should also be understood that the methods described herein are not limited to being executed as software on a computer or DSP (Digital Signal Processor), but may also be implemented in a hardware processor. For example, the methods may be implemented with HDL (Hardware Design Language) in an application-specific integrated circuit (ASIC).

FIG. 1 illustrates an exemplary scanning system configuration, wherein a plurality of readers 112 are being operated or utilized in a remote location, such as in a delivery truck.

An exemplary data reader 112 may have a number of subsystems supported by a housing 117 configured to be hand held. An exemplary data reader 112 may have a number of subsystems for providing an operator with feedback as to operation or functionality of the reader. Various reading or operational modes may be either preprogrammed or be made menu selectable by an operator.

Disposed in the housing may be one or more data readers for obtaining information from an information bearing medium, such as a symbol indicia (such as one or two dimensional symbologies), an RFID instrument, a card having a magnetic strip (mag strip) or biometric information such as a fingerprint, etc.

Exemplary data readers may be in communication (wired or wireless) to a local data processing system 140, such as a cash register, customer station or employee station or local host/server 122 directly or through a charging station or base 138. An exemplary local server 122 or data reader 112 may be in communication with network 120 and or a remote/web server 134.

A reader may be in communication (wired or wireless) with the internet through the use of a local processing system 130, such as might be resident on a local server or computer having a wired or wireless router for providing internet service to a device or devices such as PDTs. The local processing system 130 may be in communication via the internet with a remote/web server 134 through a wired or wireless connection for the transfer of information over a distance without the use of electrical conductors or "wires". The distances involved may be short (a few meters as in television remote control) or very long (thousands or even millions of kilometers for radio communications). Wireless communication may involve radio frequency communication. Applications may involve point-to-point communication, point-to-multipoint communication, broadcasting, cellular networks and other wireless networks. This may involve: cordless telephony such as DECT (Digital Enhanced Cordless Telecommunications); Cellular systems such as 0G, 1G, 2G, 3G or 4G; Short-range point-to-point communication such as IrDA (Infrared Data Association, a standard for communication between devices over short distances using infrared signals) or RFID (Radio Frequency Identification), Wireless USB (Universal Serial Bus), DSRC (Dedicated Short Range Communications); a low-cost, low-power, wireless mesh network standard such as ZIGBEE; open wireless technology standard for exchanging data over short distances such as BLUETOOTH or a radio technology which may be used at a very low energy level for short-range, high-bandwidth communications using a large portion of the radio spectrum such as a ultra-wideband (UWB from WIMEDIA Alliance); Wireless computer networks such as Wireless Local Area Networks (WLAN), IEEE 802.11 branded as WiFi or HIPERLAN; or Wireless Metropolitan Area Networks (WMAN) and Broadband Fixed Access (BWA) such as LMDS (Local Multipoint Distribution Service), WiMAX or HIPERMAN.

The Internet is the worldwide, publicly accessible network of interconnected computer networks that transmit data by packet switching using the standard Internet Protocol (IP). It is a "network of networks" that consists of millions of smaller domestic, academic, business, and government networks, which together carry various information and services, such as electronic mail, online chat, file transfer, and the interlinked Web pages and other documents of the World Wide Web. The IP is a data-oriented protocol used for communicating data across a packet-switched internetwork, and may be a network layer protocol in the internet protocol suite and encapsulated in a data link layer protocol (e.g., Ethernet). As a lower layer protocol, the IP provides the service of communicable unique global addressing amongst computers to provide a service not necessarily available with a data link layer.

An operator may aim a hand-held indicia reader 112 at a target containing an information bearing medium (IBM), dataform, text, or other data to be collected and actuate a button or trigger 115 on the indicia reader to control full or partial operation of the reader, such as to activate scanning of an IBM or reading a RFID tag. An IBM or dataform may be an originally machine generated symbology that is also machine readable, such as a 1-D barcode, a 2-D barcode, a 1-D stacked barcode, a logo, glyphs, color-codes, and the like.

Exemplary data readers are portable and wireless in nature thereby providing mobility and flexibility and form part of a wireless network in which data collected within the readers is communicated to a host computer situated on a backbone via a wireless link. Readers may include a radio or transceiver for communicating with a remote computer. An exemplary reader is carried by an operator who drives a vehicle to various locations, such as is done as part of a package delivery service.

An exemplary data reader 112 may be a mobile device, such as a hand held scanner, a portable data terminal (PDT), personal digital assistant (PDA), mobile phone, etc. A Portable Data Terminal, or PDT, is typically an electronic device that is used to enter or retrieve data via wireless transmission (WLAN or WWAN (wireless wide area network)) and may also serve as an data reader used in stores, warehouse, hospital, or in the field to access a database from a remote location. Personal Digital Assistants (PDAs) are handheld devices typically used as a personal organizer, and may have many uses such as calculating, use as a clock and calendar, playing computer games, accessing the Internet, sending and receiving E-mails, use as a radio or stereo, video recording, recording notes, use as an address book, and use as a spreadsheet.

PDTs may be equipped with the ability to query and receive and transmit data, such as software via a communication link, such as by radio link or wired link. Upgrading firmware from host processor to PDT (also referred to as uploading or pushing) and duplicating configuration parameters may be performed by reading specific indicia to ensure PDTs are operating at the proper revision and have the proper configuration parameters.

A PDT may be an electronic device that is used to enter or retrieve data via wireless transmission (WLAN or WWAN) and may also serve as an indicia reader used in a stores, warehouse, hospital, or in the field to access a database from a remote location.

Exemplary mobile devices (also referred to as smart phones, handheld devices, handheld computers, PDAs, PDTs, etc.) may be described as pocket-sized computing devices, typically having a display screen with touch input or a miniature keypad. In some mobile devices the input and output are combined into a touch-screen interface. Enterprise digital assistants further extend the available functionality of mobile devices.

An Enterprise digital assistant (EDA) is a handheld computer adapted for usage with SME (Small to Medium Enterprise) and Enterprise business Application software-|Applications as a data capture mobile device. Such data capture applications include indicia readers, biometrics, magnetic stripe, smart card and RFID data capture technologies used within communication networks such as WLANs (Wireless Local Area Networks), Bluetooth, Wide area network|WAN/LAN/Personal Area Network|PAN voice and data communications, VOIP (Voice over IP) and GPRS (General packet radio service) Edge Communications.

In an exemplary embodiment, a mobile device 112 may be utilized to monitor the driving habits of operators. The mobile device may monitor, collect and log vehicle and system information or events such as idle time, miles traveled, rollover scenarios, speed, sudden accelerations/decelerations, etc.

An exemplary mobile device 112 may provide audible and visual warnings and information to alert a driver of unsafe driving and handling practices.

Vehicle operational data may also be sent via WWAN to an enterprise home database for real time monitoring or for data storage or logging. Logged data may be utilized to analyze accident or other driving scenarios.

In an exemplary embodiment a mobile device may be used to monitor trailer loads by utilizing sensors such as accelerometers to determine if the trailer is off axis, thereby indicating improper trailer loading.

In an exemplary embodiment a mobile device may be used for other functions such as for GPS navigation/turn-by-turn, real time data communications, indicia scanning for proof of delivery, etc.

Figure 2:
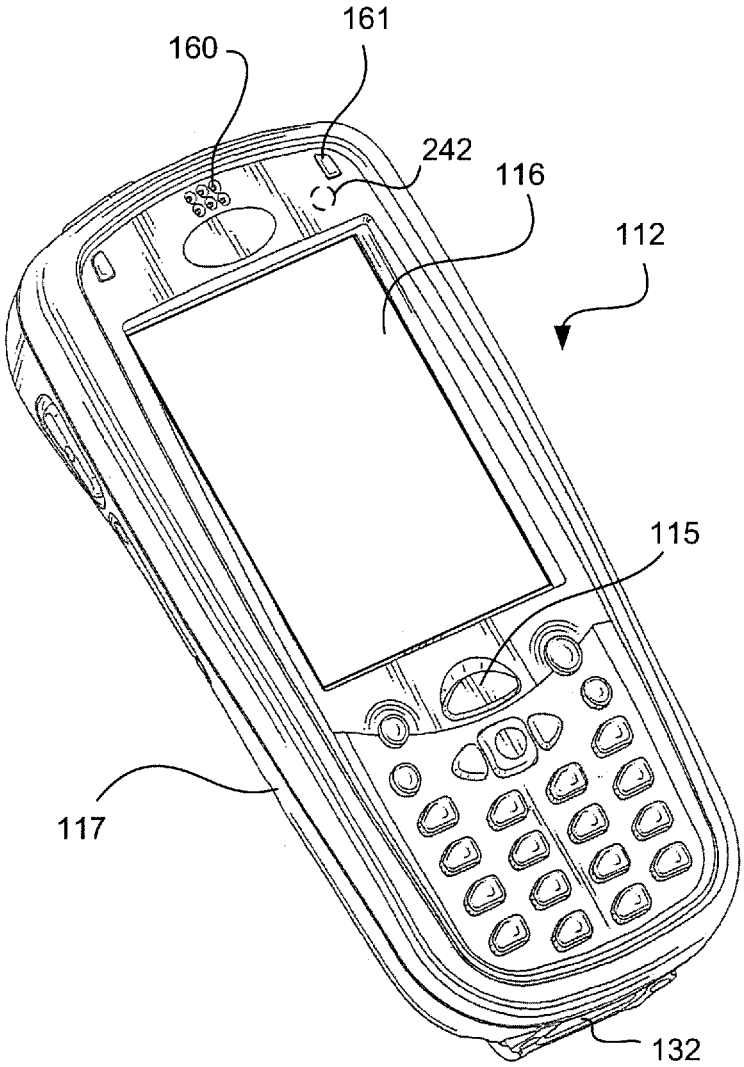
FIG. 2 is a perspective view of an exemplary data reader.

Referring to FIG. 2, an exemplary data reader 112 may comprise a display, a trigger 115, a data collection device, such as an accelerometer 242 and other exemplary subsystems supported by a housing 117. Data may be transferred to and from the reader through a connector 132.

Figure 3:
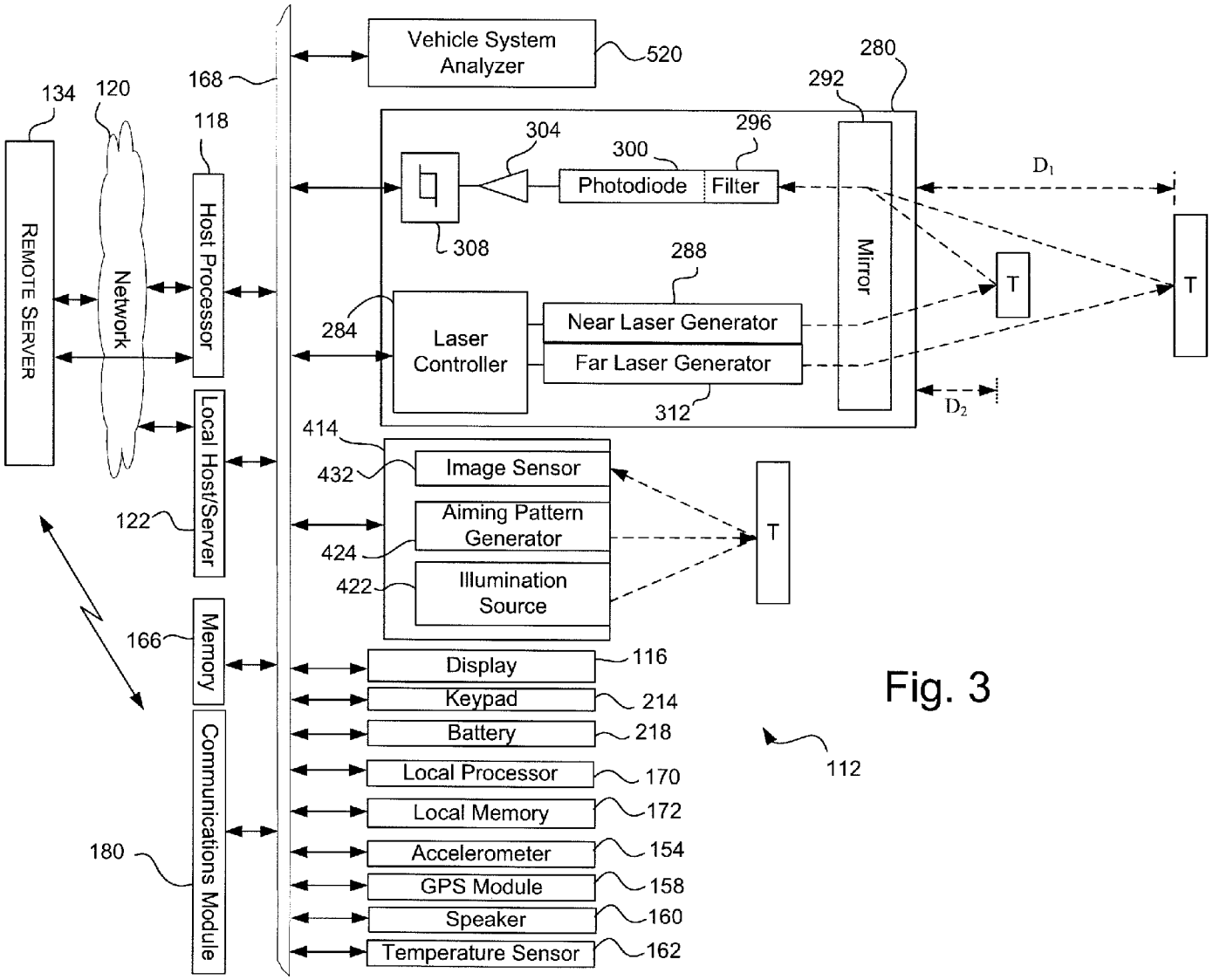
FIG. 3 is a simplified schematic block diagram of an exemplary data reader.

Referring to FIG. 3, an exemplary indicia reader 112 may comprise a number of exemplary subsystems, such as a laser scan engine 280 or laser scanning reader system for reading indicia on a target T. The laser scanning reader system may comprise a near laser controller 284 for controlling a near laser generator 288 for generating a near laser scanning pattern which is directed by an oscillating or rotating mirror 292 onto a near target T. The near laser scanning pattern is reflected off of the target and redirected by mirror 292 into a receive path comprising a laser light pass filter 296, a photodiode 300, an amplifier 304 and a digitizer 308. Laser controller 284 may also control a far laser generator 312 for generating a far laser scanning pattern which is directed by the oscillating or rotating mirror 292 onto a far target T. The far laser scanning pattern is reflected off of the target and redirected by mirror 292 into the receive path.

Digitizer 308 may convert an analog signal output by the photodiode into a digital signal representative of the light reflected off of the targets.

Exemplary laser scanners use a laser beam as the light source and employ either a reciprocating mirror or a rotating prism to scan the laser beam back and forth across the (information bearing indicia) IBI. One or more photodiodes are used to measure the intensity of the light reflected back from the bar code. The light emitted by the reader is rapidly varied in brightness with a data pattern and the photodiode receive circuit is designed to detect only signals with the same modulated pattern.

An exemplary photodetector or photosensor may be comprised of one or more photodiodes that converts incident light energy into electric charge that is an output signal representative of light reflected off an IBI. The output of the photodetector may be processed utilizing one or more functions or algorithms to condition the signal appropriately for use in further processing downstream.

Laser light may be described as a spatially coherent, narrow low-divergence beam of light. The output signal of the photodetector may be processed utilizing one or more functions or algorithms to condition the signal appropriately for use in further processing downstream, including decoding of IBIs. Laser scanning reader system 280 may be configured for scanning an IBI at a distance $D_1$ and at a distance $D_2$, which is a shorter distance from the reader 112 than $D_1$.

An exemplary data reader 112 may comprise one or more optical image engines (image indicia reader systems or optical scan engines) 414 for reading information bearing medium on a target T. Optical image engines capture and read images to detect and decode symbology located within the captured images. The optical image indicia reader systems may comprise one or more illumination source(s) 422 for illuminating an IBM with a beam or pattern of incoherent light in the form of an illumination pattern and a light receive circuit comprising an image sensor 432 for converting light reflected off a target T having an IBM provided thereon into representative output signals thereof. The output signal of the image sensor may be processed utilizing one or more functions or algorithms to condition the signal appropriately for use in further processing downstream, including decoding of IBMs.

In an exemplary embodiment, an indicia reader is provided both an optical image indicia reader and a laser scanner indicia reader, the activation of both readers being accomplished by an operator actuating a single trigger with multiple pulls.

The light receive circuit may utilize imaging optics to focus light on the image sensor 432. Illumination source 422 may comprise an illumination source and illumination optics.

An exemplary optical image indicia reader may have an aiming pattern generator 424 for transmitting an aiming pattern on the target to assist an operator to properly scan indicia on the target. The aiming pattern generator may comprise an aiming generator light source, an aiming aperture and aiming optics.

An exemplary image sensor converts light or other electromagnetic energy reflected off of a target and provides an output signal representative thereof. Image sensor may be an array of pixels adapted to operate in a global shutter or full frame operating mode such as a color or monochrome 2D CCD (two dimensional charge-coupled device), CMOS (Complementary metal-oxide-semiconductor), NMOS (n-channel MOSFET), PMOS (p-channel MOSFET), CID (Continuous initiator dosing), CMD (California Micro Devices), back-illuminated, etc. solid state image sensor. The image sensor may contain an array of light sensitive photodiodes (or pixels) that convert incident light energy into electric charge. Solid state image sensors allow regions of a full frame of image data to be addressed.

Illumination and aiming light sources may comprise any light source to provide a desired illumination pattern at the target and may be one or more LEDs (light emitting diodes). Illumination and aiming light sources with different colors may be utilized. For example, in one such embodiment the image reader may include white and red LEDs, red and green LEDs, white, red, and green LEDs, or some other combination chosen in response to, for example, the color of the symbols most commonly imaged by the image reader. Different colored LEDs may be each alternatively pulsed at a level in accordance with an overall power budget.

Other exemplary reader subsystems or components supported by the housing may include one or more local or on board processor(s) 170, local memory 172, a battery 218, a display 116, a key pad 214 and a wireless communications module 180. The subsystems may communicate via one or more bus 168, data lines or other signal or data communication form. The indicia reader may communicate with one or more local processor(s) 118, a local host/server 122, local memory 166, network 120 or remote server host/server 134.

Other exemplary reader subsystems or components may be one or more data collection devices, such as an accelerometer 154, a GPS module 158, a speaker 160, an alerting LED 161, a vehicle system analyzer 520 and a temperature sensor 162.

In an exemplary embodiment, these data collection devices may be utilized to collect data with regard to the performance of a vehicle.

Communications module 180 may provide a communication link from imaging reader 112 to other indicia readers or to other systems such as a server/remote processor 134.

The processor(s) may be located on board or within the housing with other subsystems. The particulars of the functionality of the processor(s) and the reader may be determined by or based upon certain configuration settings or data which may be stored in firmware, remote or local memory.

An exemplary processor may be a mixed-signal array with on-chip controller devices designed to replace multiple traditional MCU-based system (microcontroller unit (MCU) is a single chip that contains a processor, RAM, ROM, clock and I/O control unit) components with one single-chip programmable device. It may include configurable blocks of analog and digital logic, as well as programmable interconnects.

The reader subsystems in the reader may be connected by one or more bus 168, data lines or other signal or data communication form. Exemplary forms may be an Inter-IC bus such as a two wire interface (TWI), dedicated data bus, RS232 interface, USB, etc.

The processor(s) may include a predetermined amount of memory for storing firmware and data. The firmware may be a software program or set of instructions embedded in or programmed on the processor(s) which provides the necessary instructions for how the processor(s) operate and communicate with other hardware. The firmware may be stored in the flash memory (ROM) of the processor(s) as a binary image file and may be erased and rewritten. The firmware may be considered "semi-permanent" since it remains the same unless it is updated. This firmware update or load may be handled by a device driver.

The processor(s) may be utilized to perform a number of functional operations, which may involve the performance of a number of related steps, the particulars of which may be determined by or based upon certain configuration settings stored in firmware or memory which may be any one of a number of memory types such as RAM, ROM, EEPROM (Electrically Erasable Programmable Read-Only Memory), etc. In addition some memory functions may be stored in memory provided as part of the processor(s).

Exemplary functions of the processor(s) may be controlling operation the scan engine, decoding functions and operator interface functions. Operating software may be utilized to operate the processor(s) for such functions seemingly simultaneously or in a multitasking role. An exemplary image reader operating software architecture may be organized into processes or threads of execution.

Processor(s), memory and associated circuitry which perform or control the exemplary scan and decoding functions may be provided in the scan engine or on associated circuit boards which are located within the housing of the reader. Decoding is a term used to describe the interpretation of a machine readable code contained in the photodetector output signal.

An exemplary function of the processor(s) may be to decode machine readable symbology provided within the target or captured image. One dimensional symbologies may include very large to ultra-small, Code 128, Interleaved 2 of 5, Codabar, Code 93, Code 11, Code 39, UPC (Universal Product Code), EAN (European Article Number), MSI, (a barcode symbology developed by the MSI Data Corporation, based on the original Plessey Code symbology. It is a continuous symbology that is not self-checking.) or other 1D symbologies. Stacked 1D symbologies may include PDF, Code 16K, Code 49, or other stacked 1D symbologies. 2D (two dimensional) symbologies may include AZTEC, DATAMATRIX, MAXICODE, QR-CODE, or other 2D symbologies.

Operation of the decoding, which may be executed in a user or factory selectable relationship to a scanning routine, may be governed by parameters or configuration settings. Combinations of scanning and decoding parameters together define scanning-decoding relationships or modes which the reader will use. Two exemplary modes may be continuous or discontinuous. In the continuous mode (also referred to as continuous scanning mode, continuous streaming mode, streaming mode, fly-by scanning mode, on the fly scanning mode or presentation mode) the reader is held in a stationary manner and targets (such as symbols located on packages) are passed by the reader. In the continuous mode, the reader takes continuous scans one after another (seriatim) and continuously decodes or attempts to decode some or all scanned targets. Discontinuous mode is a mode wherein scanning and/or decoding stops or is interrupted and initiated with an actuation event, such as pulling of a trigger 115, a timeout, or a successful read to restart. An exemplary utilization of the reader in discontinuous mode is via hand held operation. Decoding stops once the indicia reader is no longer triggered. The discontinuous mode is typically initiated because the operator knows a symbol is present.

Exemplary indicia readers may use memory or firmware to store certain reader settings or reader configuration settings. Exemplary configuration settings may be selection of scanning distance, trigger functionality, pre-defined bar code output data based on the scan input, continuous scanning mode, discontinuous scanning mode or routine, decoding mode or routine, I/O configurations, symbology enablement, output interface functionality, min/max symbology character lengths, scan engine selection, illumination functionality, settings that affect the functional operation of the processor(s), which codes are enabled for processing, aimer operation, engine orientation, illumination, photosensor functionality, software control, sales tracking or warranty tracking, reader capabilities, etc.

Readers and a host system may be equipped with the ability to automatically query and communicate data, such as configuration settings or firmware amongst each other. Upgrading firmware from host to reader and duplicating configuration settings may be performed without human intervention to ensure readers are operating at the same revision and have the same configuration settings reduces user frustration, down time, data integrity and increase efficiencies.

At predetermined time intervals a host system may broadcast various information, such as firmware revision, configuration settings, etc. The host may then download the newer files and update readers during a time of inactivity. Readers may use on board memory or firmware flash memory to store certain configuration settings.

Readers may be configured by means of bar codes or via serial connection using serial commands. A GUI (graphic user interface) may be utilized for creating or reading serial commands, such as a software that enables building DHTML menus, such as VISUAL MENU or similar such product. This may be done locally or remotely by connecting the optical reader either directly or through a network (such as the internet) to a remote computer and having the remote computer provide software upgrades.

Software upgrades may be necessary for migration from one reader to new or other readers, possibly different manufacturers. Upgrading may be simplified if the configuration of the reader being replaced is matched or matches the configuration of the equipment that it is replacing.

If reader software is replaced, the reader may have the ability to automatically read out configuration settings information in memory and allow the software to adapt and use different methods of control, or different methods of decoding, etc.

An exemplary embodiment for upgrading may be to provide a PC based software tool to read out the non-default configuration settings from a target reader device (the one being replaced) through a serial communication and then to flash the same or equivalent settings into the replacement equipment. This may be considered a direct configuration mapping method, that is, reading the configuration settings on a (old) Device A and flashing them into a (new) Device B.

Another exemplary embodiment may be to provide a PC based software tool that analyzes output scanned data of a known information bearing indicia from a target reader (the one being replaced) and compares it with the output scanned data from the replacement reader. The software tool may interpret how the existing device is configured based on the difference between the two sets of scanned data. After interpolation of the configuration settings of the replacement reader, the software tool would configure the replacement reader to match the old or replacement reader. This may be considered indirect mapping, wherein the software tool interpolates the inner settings of an existing device from its operation, rather than by direct read out from memory or firmware.

Either exemplary embodiment may be integrated with a cross-browser, client-side DHTML (an umbrella term for a collection of technologies used together to create interactive and animated web sites) menu builder such as Visual Menu. The configuration of a reader may be read out once and then propagated many times using wireless or over-the-net configuration utilities, hard copy or video display menuing or other suitable means.

A user may update or replace one or more stored configuration settings or configuration setting data utilizing a remote updating system which may be done by connecting the reader either directly or through a network (such as the internet) to a remote processor. With appropriate software, the remote processor may be programmed to read certain configuration settings from the reader, such as software configuration. The remote processor may read the configuration setting data and utilize that data when downloading updates or new software. An operator may request from the remote processor for a software update. The request would be received by either computer, which could read the current software configuration resident on the optical reader and determine the appropriate update or replacement software.

In an exemplary embodiment, enterprise trucking, delivery, courier, route accounting, etc. companies may utilize need to monitor vehicle characteristics, such as the driving habits of the drivers in their fleets in order to ensure safety on the road, maintain vehicle performance, mitigate legal (driving) violations, etc.

An exemplary mobile device may support integrated sensor and receiver technologies (such as accelerometers, GPS receivers, vehicle system analyzers, etc.) that can monitor, collect and log vehicle and system information such as idle time, miles traveled, rollover scenarios, speed, sudden accelerations/decelerations, etc. The sensor/receiver technologies may be integrated into the mobile device computing architecture and develop a software package to monitor and log (time/date stamp) the vehicle events.

An accelerometer measures proper acceleration, which is the acceleration it experiences relative to freefall, and is the acceleration that is felt by objects. Such accelerations may be measured in terms of g-force. At any point in spacetime the equivalence principle guarantees the existence of a local inertial frame, and an accelerometer measures the acceleration relative to that frame.

Exemplary vehicle system analyzers may be used to monitor such things the vehicle battery, charging, staffing, arid fuel systems, ignition systems, engine conditions, tire air pressure, speed, etc. In an exemplary embodiment, a mobile device may be connected to a vehicle system analyzer which is resident on the vehicle.

In an exemplary embodiment vehicle data may be used to prevent driver violations and Dept of Transportation (DOT) and Ministry of Transportation (MOT) violations by utilizing audible and visual feedback to alert the driver and inform them to maintain safe handling practices.

In an exemplary embodiment the vehicle might encounter errors, faults, problems, operational situations or otherwise not function properly or operate in a manner the operator or enterprise is expecting or desires. For these and other situations or error conditions, the operator or enterprise is not likely to know the source of the problem. The mobile device may be provided with an audio speaker driven by a programmable electrical audio signal wherein the mobile device stores audio messages within memory. A processor diagnoses or recognizes when the vehicle performance is problematic and makes a determination of the cause for the performance and sends different audio messages to the speaker to be broadcast by the speaker to provide the operator with audio voice synthesized information regarding vehicle performance. In and exemplary embodiment, the mobile device is equipped with a visual indicator, such as one or more LEDs that provide the operator with information regarding vehicle performance.

In an exemplary embodiment, the data may be sent wirelessly to the enterprise's database for real time monitoring or data storage. The logged data may be utilized in accident scenarios.

In an exemplary embodiment, the mobile devices may be used to monitor trailer loads by using the sensors to determine if the trailer is off axis.

In exemplary embodiment, the mobile device may be utilized for GPS navigation, turn-by-turn instructions, real time data communications, bar code decoding for proof of delivery, etc.

An exemplary embodiment mobile device has optical indicia readers that may be used for a CCTV (Closed Circuit Television) application to provide security in a vehicle. Optical indicia readers may be left idle or otherwise when not in use for scanning indicia. When an optical indicia reader is not in use reading IBIs, it can be configured to automatically capture continuous or periodic images. The captured images may then be utilized for security purposes. For example, an optical indicia reader may be pointed so that a region of interest such as the inside of the vehicle or an area in front of the vehicle within the field of view (FOV) of the imager of the reader. To facilitate this, the reader may be placed in a cradle, base or stand.

In an exemplary embodiment the reader may be configured to send captured images to the enterprise server for archiving, processing, etc. In an exemplary embodiment the images are archived or stored in memory or on a recording medium, such as a digital video recorder (DVR). In an exemplary embodiment the reader may be configured to send captured images directly to a local host server or processor to be archived.

In an exemplary embodiment, captured images may be archived and/or processed in the reader. Processing of captured images may comprise triggering a video surveillance system to have remote cameras focused and/or recording.

In an exemplary embodiment, the reader may be utilized to signal or alert a video surveillance system (VSS) and start recording surveillance video or images in the region of interest the reader was imaging. The VSS may also start storing images captured by the reader.

In an exemplary embodiment the reader processes captured images to detect an event or change in a region of interest, such as motion of an object. An event may be sudden acceleration/deceleration of the vehicle. If there is a change detected, the reader may be utilized to signal one or more security cameras near or nearest the region of interest. For example, a video surveillance server may be alerted to focus on an area where a predetermined activity or scene change is detected. A video surveillance server may control one or more PTZ (pan tilt zoom) cameras and/or fixed cameras to record video based on certain events. In an exemplary embodiment PTZ cameras may be running according to preset tours and an indicia reader may be used as an alerting mechanism to run them.

In an exemplary embodiment the indicia reader captures images within it's field of view and sends them to the video surveillance server periodically. The server may process these images, alert PTZ cameras to set their focus to the respective reader's field of view and start recording.

In an exemplary embodiment, location information is transmitted from the reader to a remote server when an event or change in a region of interest is detected.

In an exemplary embodiment the indicia reader may support video analysis and perform the processing of images. The indicia reader may have enough memory to store the images.

An exemplary indicia reader may adjust security camera parameters, such as exposure, iris, focus or other settings based on conditions it detects such as ambient lighting conditions.

An exemplary indicia reader may be used as a standalone alerting device. For example the indicia reader may capture and store images of a region of interest after a detected security event and alert or notify personnel with an audible or visual signal emanating from the indicia reader. A security event may be such things as motion or movement in the region of interest, displacement of objects in the region of interest, unusual motion of the vehicle, sudden acceleration/deceleration, etc.

Figure 4:
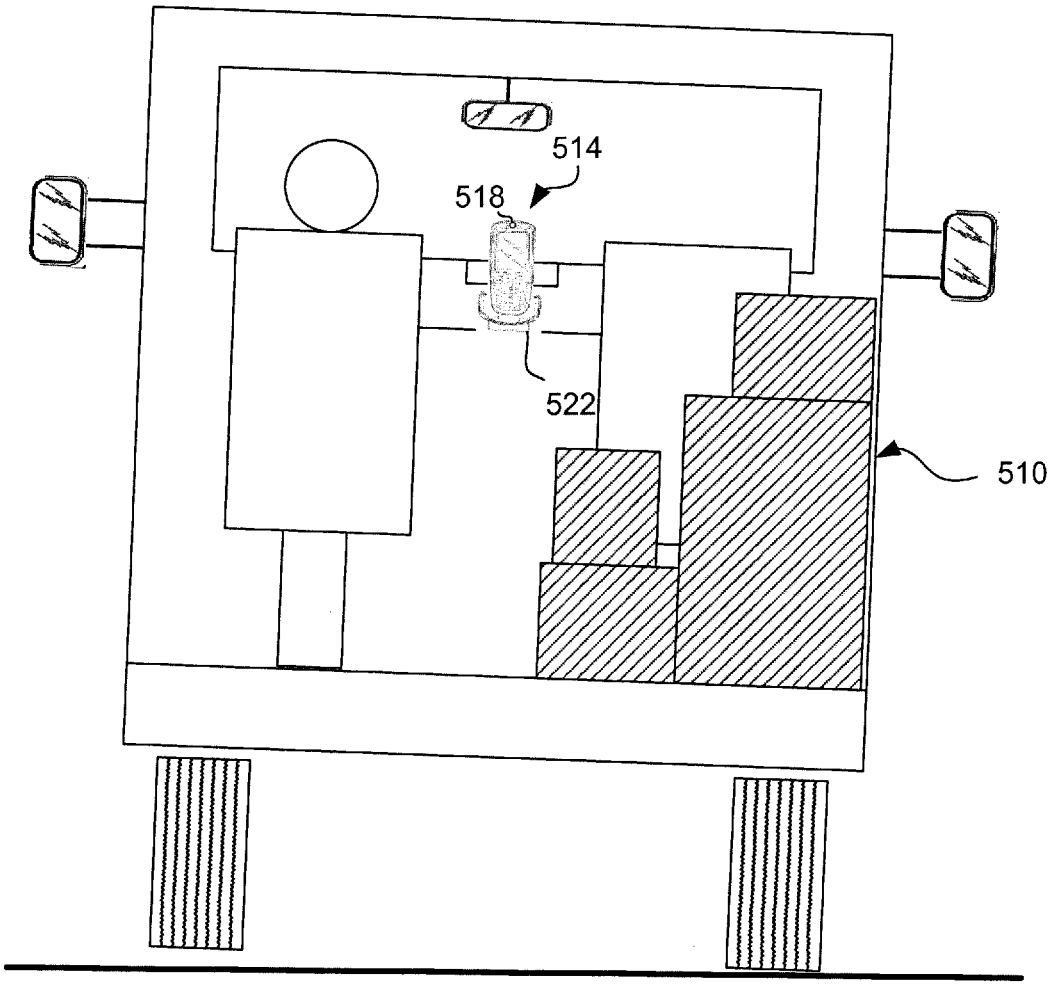
FIG. 4 is a rear view of an exemplary vehicle having an exemplary data reader.

FIG. 4 illustrates an exemplary mobile device 514 that has a data collection device 518 utilized for tracking vehicular performance characteristics, such as off center package loading. In an exemplary embodiment, the data reader may be placed in a base 522 which is attached to the vehicle.

It should be understood that the programs, processes, methods and apparatus described herein are not related or limited to any particular type of computer or network apparatus (hardware or software). Various types of general purpose or specialized computer apparatus may be used with or perform operations in accordance with the teachings described herein. While various elements of the preferred embodiments have been described as being implemented in software, in other embodiments hardware or firmware implementations may alternatively be used, and vice-versa. The illustrated embodiments are exemplary only, and should not be taken as limiting the scope of the present invention. For example, the steps of the flow diagrams may be taken in sequences other than those described, and more, fewer or other elements may be used in the block diagrams. Also, unless applicants have expressly disavowed any subject matter within this application, no particular embodiment or subject matter is considered to be disavowed herein.

The invention claimed is:

1. A mobile device comprising:

a data reader comprising an optical image indicia reader configured for reading symbology from a captured image, said data reader comprising a wireless communications module in electronic communication with a memory device and processor; and a vehicle data collection device configured to monitor at least one vehicle performance characteristic;

wherein the data reader comprises a near laser generator that generates a near laser scanning pattern which is directed onto a near target and a far laser generator that generates a far laser scanning pattern which is directed onto a far target wherein the far target is farther away from the data reader than the near target;

wherein said data reader is configured for placing in a vehicle and pointing such that a region of interest in the vehicle is within a field of view of the data reader and such that said data reader captures images of said region of interest, processes said images, and upon detecting a change in the region of interest, provides a signal as an alerting mechanism to said vehicle data collection device; and wherein said region of interest within the vehicle comprises an area for loading packages.

2. A mobile device in accordance with claim 1, wherein said vehicle data collection device further comprises at least one of the following: a display in the vehicle, a global positioning system (GPS), an accelerometer; an engine analyzer and a vehicle system analyzer.

3. A mobile device in accordance with claim 2, wherein the monitored at least one vehicle performance characteristic comprises at least one of the following: engine idle time; miles traveled; rollovers; speed; vehicle battery charge; fuel system conditions; ignition system conditions, engine operating conditions; tire air pressure; trailer load conditions; accelerations and decelerations.

4. A mobile device in accordance with claim 1, wherein the monitored at least one vehicle performance characteristic is logged according to time and date.

5. A mobile device in accordance with claim 1, wherein the data reader is an optical indicia reader configured to automatically capture continuous or periodic images upon the occurrence of a predetermined vehicle performance characteristic.

6. A mobile device according to claim 1, wherein said vehicle data collection device is a camera, and said alerting mechanism is a recording start signal.

7. A mobile device according to claim 1, wherein said vehicle data collection device collects location information, and said reader transmits location information to a remote server upon detecting said change.

8. A mobile device in accordance with claim 1, wherein said change in the region of interest comprises an off center package load.

9. A mobile device comprising:

a data reader configured to read data from an information bearing medium;

at least one vehicle data collection device in electronic communication with said data reader;

a memory device; and a processor;

wherein the vehicle data collection device facilitates monitoring at least one vehicle performance characteristic;

wherein the data reader comprises an optical image indicia reader configured for reading symbology from a captured image, wherein said data reader is further configured for placing in a vehicle and pointing such that a region of interest in the vehicle is within a field of view of the data reader and such that said data reader captures images of said region of interest, processes said images, and upon detecting a change in the region of interest, provides a signal as an alerting mechanism to said vehicle data collection device; and wherein said region of interest within the vehicle comprises an area for loading packages.

10. A mobile device in accordance with claim 9, wherein the mobile device provides audible and/or visual information alerting a driver of unsafe driving and handling practices.

11. A mobile device according to claim 9, wherein said alerting mechanism further initiates an audible or visual signal emanating from said data reader.

12. A mobile device according to claim 9, wherein said vehicle data collection device is a camera, and said alerting mechanism is a recording start signal.

13. A mobile device according to claim 9, wherein said vehicle data collection device collects location information, and said reader transmits location information to a remote server upon detecting said change.

14. A mobile device according to claim 9, wherein said data reader calculates parameters for adjusting said vehicle data collection device.

15. A mobile device in accordance with claim 9, wherein said change in the region of interest comprises an off center package load.

16. A mobile device comprising:

a hand held data reader comprising an optical image indicia reader configured for reading symbology from a captured image, and configured to be positioned in a stand inside a vehicle during periods when the data reader is not used for reading symbology, said hand held data reader comprising a wireless communications module, a memory device and a processor; and at least one vehicle data collection device positioned in the vehicle and in electronic communication with said data reader, wherein said data reader is configured for pointing such that a region of interest in the vehicle is within a field of view of the data reader and such that said data reader captures images of said region of interest, processes said images, and upon detecting a change in the region of interest, provides a signal as an alerting mechanism to said vehicle data collection device;

wherein said region of interest within the vehicle comprises an area for loading packages.

17. A mobile data reader according to claim 16, configured to transmit said images via said wireless communications module to a remote server.

18. A mobile data reader according to claim 17, wherein said vehicle data collection device is a camera, and said server alerts said camera to set a focus parameter to the data reader's field of view.

19. A mobile data reader according to claim 16, wherein said data reader is configured to read either information bearing media in one dimensional or two dimensional symbol indicia during times of reading data.

20. A mobile device in accordance with claim 16, wherein said change in the region of interest comprises an off center package load.

* * * * *